United States Patent [19]

Haines

[11] 3,954,319

[45] May 4, 1976

[54] ENVIRONMENT PROOF ELECTRICAL CONNECTOR ASSEMBLY

[75] Inventor: Warren L. Haines, Santa Ana, Calif.

[73] Assignee: Hughes Aircraft Company, Culver City, Calif.

[22] Filed: May 20, 1974

[21] Appl. No.: 471,615

[52] U.S. Cl. ..... 339/94 M

[51] Int. Cl.[2] ..... H01R 7/02

[58] Field of Search ..... 339/184 R, 184 M, 49 R, 339/94 R, 94 C, 94 M, 206 R, 91 R, 91 P, 94 A, 59 R, 59 M, 60 R, 60 M

[56] References Cited

UNITED STATES PATENTS

| | | | |
|---|---|---|---|
| 2,386,177 | 10/1945 | Andersen | 339/184 M |
| 3,086,188 | 4/1963 | Ross | 339/49 R |
| 3,129,993 | 4/1964 | Ross | 339/49 R |
| 3,671,921 | 6/1972 | Baker et al. | 339/59 M |
| 3,725,845 | 4/1973 | Moulin | 339/49 R |

FOREIGN PATENTS OR APPLICATIONS

| | | | |
|---|---|---|---|
| 1,179,183 | 1/1970 | United Kingdom | 339/94 R |

*Primary Examiner*—Joseph H. McGlynn
*Assistant Examiner*—James W. Davie
*Attorney, Agent, or Firm*—W. H. MacAllister; Lewis B. Sternfels

[57] ABSTRACT

A multicontact connector intended primarily for geophysical surveying work is totally hermaphroditic to enable connection to its identical counterpart. The hermaphroditic connection also physically protects the electrical contacts and permits the connectors to be mated in only one preselected orientation thereof. Also disclosed are wire sealing means and a latching-sealing mechanism between a shell and its insert.

13 Claims, 11 Drawing Figures

ENVIRONMENT PROOF ELECTRICAL CONNECTOR ASSEMBLY

BACKGROUND OF THE INVENTION

1. Field Of The Invention

The present invention relates to electrical connector assemblies and, more particularly, to totally hermaphroditic, environmentally sealed connectors, useful in instrumentation sensors, mining exploration, remote control applications, signal circuits, and communication links, with plug-to-plug and plug-to-receptacle mating.

2. Description Of The Prior Art

In geophysical mapping of terrain, frequently for oil, geophones are distributed over the terrain in a pattern, each of them being connected through an individual or "take-off" cable to a central or main line cable which may be a mile long and which leads to an instrument truck. Subterranean characteristics are determined by detonating an explosive charge and recording in the truck electrical signals produced by the geophones in response to earth vibrations induced by the explosive.

Generally, the main cable must be placed in short sections by a team of laborers and connected together under differing terrain and environmental circumstances as described in U.S. Pat. No. 3,725,845. The invention described in U.S. Pat. No. 3,725,845 was devised to overcome problems relating to laying the main or central cable, including but not limited to protection from environmental abuses such as rough handling by unskilled labor, inundation in water and general physical damage.

The problems solved by U.S. Pat. No. 3,725,845, however, did not overcome the problems relating to the individual or take-off cables leading from the main cable to one or more geophones. In particular, it is conventional to string take-off cables from the main cable in single or multiple patterns, such as take-off cables extending from a take-off cable. The take-off cables were secured to the main cable in a straight-forward, but environmentally unprotected manner. In many cases, a splice into two or more conductors in the main cable would afford a point of connection for the take-off cable, such as by alligator clips or male and female connectors. Such a connection is acceptable provided that moisture from inclement weather or watery terrain did not establish a short circuit between exposed alligator clips or corrode exposed connectors or that rough handling did not break the electrical connections.

Furthermore, just as with connections between main cable sections, as described in U.S. Pat. No. 3,725,845, locally available laborers usually lay the take-off cable and make the take-off connections. These laborers will in most instances be totally unskilled and unfamiliar with electrical connectors and with the method of their assembly. For example, they might not know the difference between a male and a female connector and, if they do know the difference, they might lay one take-off cable with a connector of one sex adjacent to another take-off cable whose connector is of the same sex and hence not mateable.

Therefore, it has been found desirable to eliminate this possible source of error by making the connectors hermaphroditic or identical at both ends of all take-off cable sections, as was the case with main cables in U.S. Pat. No. 3,725,845, so that it does not matter which end of the take-off cable is picked up to form the electrical connection.

After the explosive charge has been detonated and readings recorded, the geophones will be repositioned in a second pattern further along the direction in which mapping is to carried out. Consequently, additional or previously used sections of the main cable and the take-off cables must be successively connected to the newly positioned geophones. Since the exploration will typically progress in a long and substantially straight line, there will come a point where the main cable cannot be extended any further by adding additional sections. At this point the truck is driven ahead and a portion of the initially laid sections of the main cable with their take-off cables are disconnected, picked up and carried downstream from the last laid main cable sections where they are connected thereto so as to further extend the main cable in the direction in which the surveying operation is to progress and to lay down the same or different pattern of geophones on take-off cables connected to the main cable. Thus, it it may be seen that in the process of geophysical exploration, main cable sections with their take-off cables have to be connected and disconnected several times each day. Due to the large amount of handling to which the connectors are subject, they are susceptible to damage. This is aggravated by the fact that main and take-off cable sections may be left in the field, as well as on the truck, unconnected to other cable sections for extended periods of time so that, unless means are provided to protect their contacts, they are subject to corrosion, abrasion and other damage.

An additional problem is that some prior art connectors utilize male and female contacts in individual connectors. Although the female contacts are fully recessed in the connector and, therefore, are relatively well protected, the male contacts are exposed pins which are, at best, protected only by a single wall which surrounds them. Thus, they are protected only collectively rather than individually and, consequently, may be damaged or bent by a hard object being carelessly pulled across them.

SUMMARY OF THE INVENTION

These and other problems are overcome by providing a connector, configured externally as either a plug or a receptacle, having totally hermaphroditic mating parts which enables its connection to its identical counterpart to provide a plug-to-plug or plug-to-receptacle connector assembly. The hermaphroditic mating parts are further provided with keying sections to enable connection between the connectors in a preselected angular orientation therebetween. As a plug, the invention further includes novel sealing and latching connections between a plug shell and a plug insert and between the plug shell and a cable electrically coupled to contacts sealed within the insert and extending to the exterior of the plug. The contacts at their mating ends are protected from physical damage by the keying sections while enabling wiping action between mating contacts when the connectors are mated. When used with the environment proof connector described in U.S. Pat. No. 3,725,845, one connector of the present invention, embodied as a receptacle, is secured to an adaptor formed as part of the patented connector.

It is therefore, an object of the present invention to provide a hermaphroditic connector securely engageable with its identical counterpart.

Another object is to provide such a connector whose hermaphroditic mating means partially houses and protects a set of contacts in such a manner that they will all engage identically supported contacts in its identical counterpart.

Another object is to provide a connector which, when connected to its identical counterpart, is made environment proof, so that all of their contacts are protected from moisture.

Another object is to provide an environmental proof connection to a main line cable.

Another object is to provide a connector having latchable cable sealing means.

Another object is to provide a connector having latchable sealing means between an insert and a shell.

Other aims and objects as well as a more complete understanding of the present invention will appear from the following explanation of an exemplary embodiment and the accompanying drawings thereof.

DESCRIPTION OF THE PREFERRED EMBODIMENTS

Figure 1:
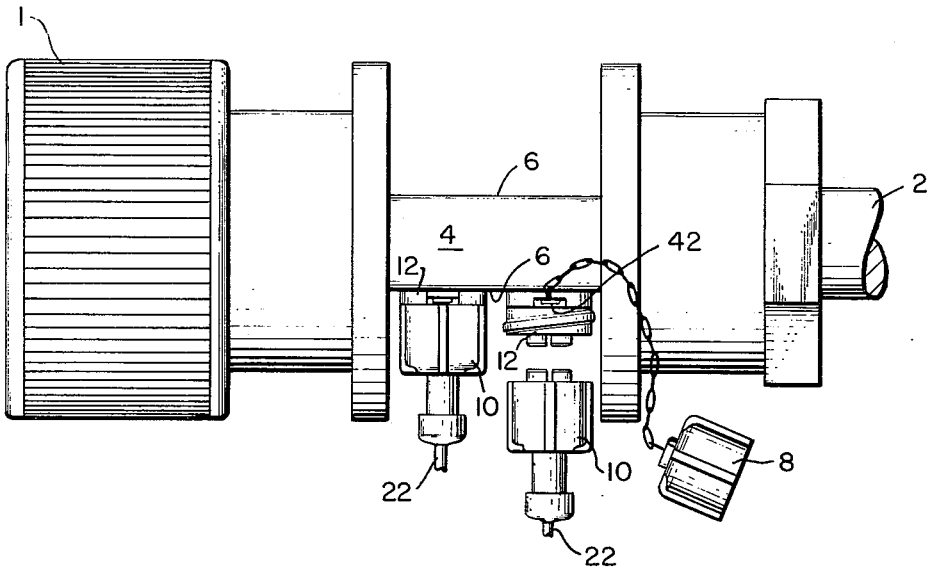
FIG. 1 illustrates one use of the present invention for hermetic attachment to a take-out adaptor on the device described in U.S. Pat. No. 3,725,845.

Referring to FIG. 1, which describes a preferred but illustrative use of the present invention, a connector 1 such as described in U.S. Pat. No. 3,725,845 terminates a main cable 2 through a take-out adaptor 4 all being secured together by seals in order to maintain environment proof protection of the interior wires. Adaptor 4 is of generally rectangular configuration in cross-section and is provided with a pair of sides 6. Although only one pair is illustrated, a pair of connector receptacles 12 are secured to both sides 6 and are environmentally sealed and internally electrically coupled to some of the main cable wires. Protective caps 8, one of which is shown, are attached to their respective receptacles 12 and adapter 4 by an attachment screw 42 (for each cap) and are used when a plug 10 is not secured to its receptacle to environmentally protect the otherwise unprotected receptacle.

A pair of plugs 10 are shown engaged or about to by engaged to receptacles 12. Although two receptacles per side 106 are used, it is to be understood that any number of receptacles and sides may be utilized, as desired. When a receptacle 12 is not used, a cap 108 is screwed onto and sealed to the receptacle.

Extending from plugs 10 are take-off cables 22 which are strung out to a geophone or pattern of geophones for use in seismic exploration. In such stringing out, plugs 10 may be required to terminate both ends of a cable 22 to enable coupling together of two or more take-out cable sections. In all cases, however, all plugs 10 are identical and have identical engagements with receptacles 12, as are described in detail with respect to FIGS. 2-11.

Figure 2:
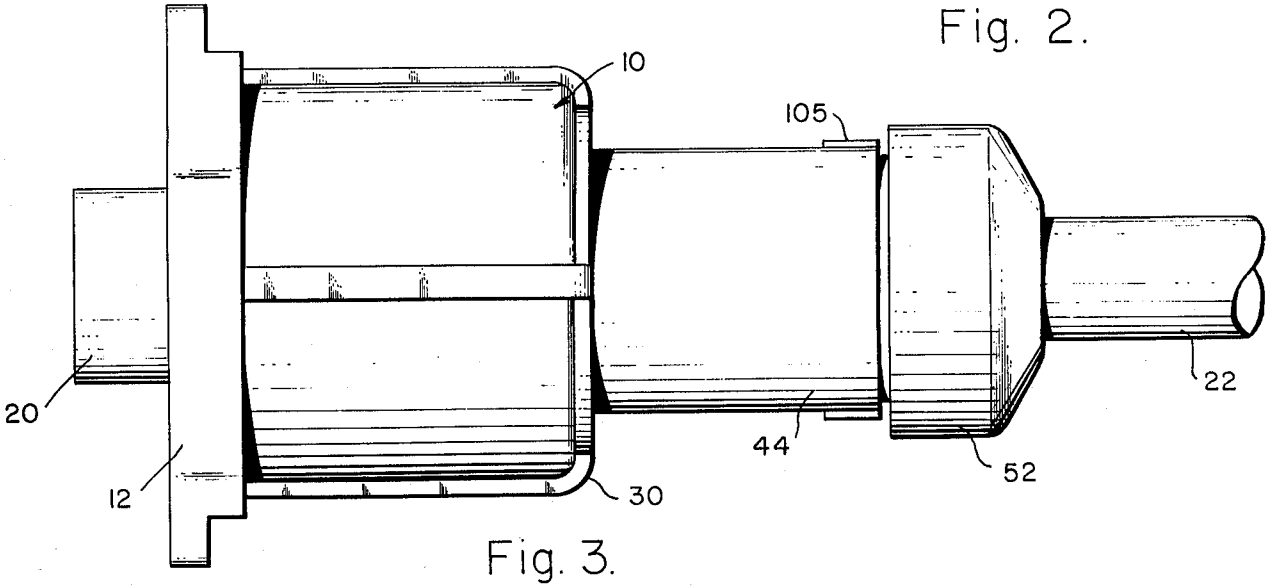
FIG. 2 is an elevational view of plug and receptacle connectors assembled together.
Figure 3:
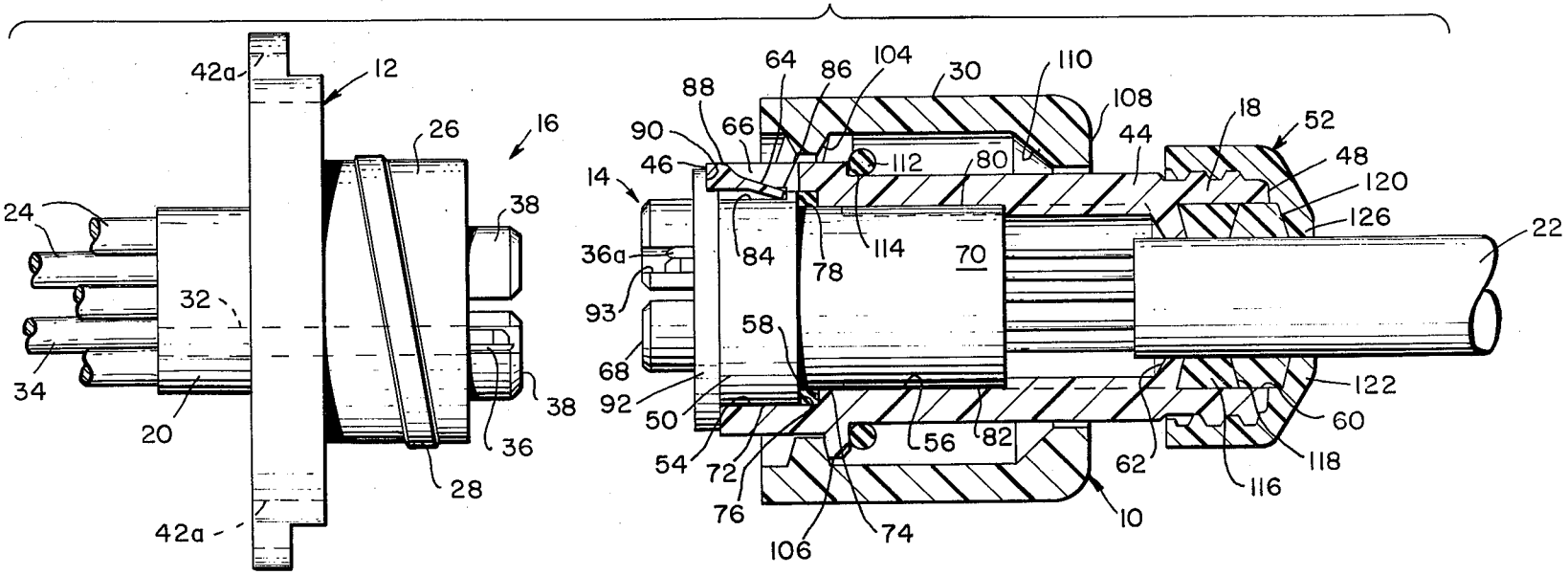
FIG. 3 is a view similar to FIG. 2 but in partial section, illustrating certain details of the plug connector.
Figure 5:
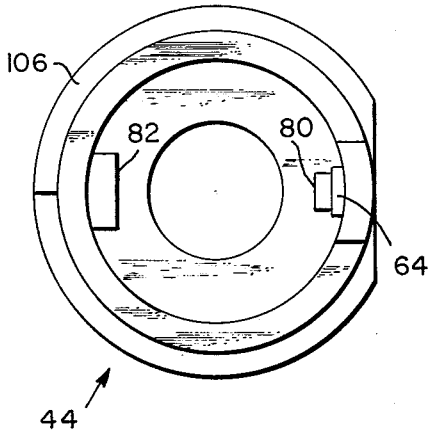
FIG. 5 is an end view of the plug shell depicted in FIG. 4.
Figure 4:
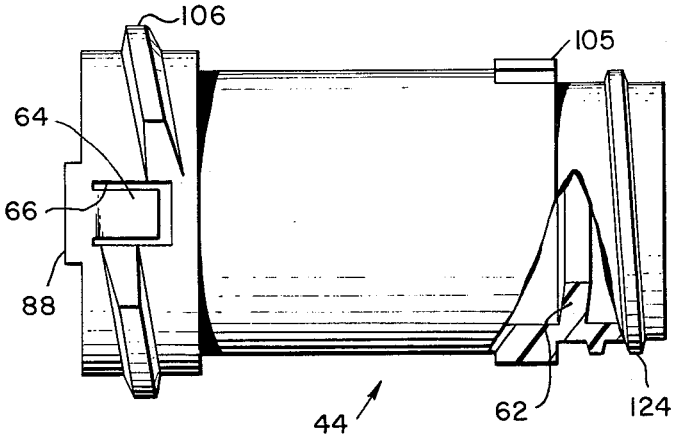
FIG. 4 is an elevational view partly in section of a plug shell.
Figure 9:
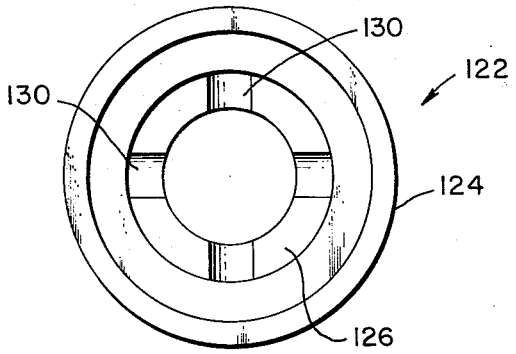
FIG. 9 is an end interior view of a gland nut used in sealing a cable within the plug shell depicted in FIG. 4.

FIGS. 2 and 3 depict a plug connector 10 and a receptacle connector 12, secured together in FIG. 2 and separated from one another in FIG. 3. It is to be understood, however, that plug connector 10 may be secured to its identical counterpart that is, to another plug connector. Connectors 10 and 12 are provided with front ends 14 and 16 respectively which are adapted to mate and to be environmentally sealed by one or two sealing gaskets, such as O-rings, therebetween, and rear ends 18 and 20 respectively through which individual wires or cables 22 and 24 extend.

Receptacle connector 12 comprises a shell 26 having thereon an external thread 28 for mating with a coupling ring 30 on plug connector 10 for securing the two together. Within shell 26 are a plurality of bores, such as bore 32 shown in dashed lines, which are spaced equally about a center line or axis 34 and which extend from rear end 20 to front end 16. Bores 32 are adapted to receive each of wires 24 and contacts 36, one of which is seen extending from front end 16. The wires are soldered or otherwise electrically connected to the contacts. At the front end of receptacle 12 are a plurality of protrusion keying sections 38 which are identical to their mating counterparts at front end 14 of plug 10. Since the front end of the plug will be described in greater detail hereinafter, further description of keying protrusion sections 38 of receptacle 12 will be deferred to a subsequent description. Receptacle 12 is completed by a flange 40 having opening 42a therein to enable the receptacle to be bolted or otherwise secured to a take-out adaptor or a housing attached to the main line connector described in U.S. Pat. No. 3,725,845.

Plug connector 10 comprises a shell 44 having a forward end 46 and a rear end 48, an insert 50 positioned within forward end 46, coupling ring 30 positioned about shell 44, and wire sealing means 52 secured to the shell at its end 48.

Shell 44 (see also FIGS. 4 and 5) is of general tubular configuration and includes a first bore 54 at its forward end 46, a second bore 56 of lesser diameter than first bore 54 extending therefrom towards rear end 48 to define with the first bore a forward facing shoulder 58, and a third bore 60 having a diameter substantially the same as second bore 56. Between the second bores is a rearwardly and radially inwardly extending annular wall 62 separating the second and third bores. A radially inwardly and canted tongue 64 is disposed within an opening 66 at forward end 46 and extends into first bore 54, being directed towards rear end 48.

Insert 50 (see also FIGS. 6–8) is provided with a front end 68 and a rear end 70 and comprises a general cylindrical body having a first section 72 of diameter substantially equal to that of first bore 54 of shell 44, a second section 74 of diameter substantially equal to that of second bore 56 of shell 44 to define with first section 72 a rearwardly facing shoulder 76. An O-ring 78 is disposed on second section 74 so that, when insert 50 is positioned within shell 44, O-ring 78 is disposed between shoulders 58 and 76, the substantially equal diameters of first bore 54 and first section 72 and of second bore 56 and second section permitting insertion of the insert within the shell. Insert 50 is further oriented with respect to shell 44 by two pairs of axially extending means 80 and 82, one of keys 80, 82 being of greater width and lesser depth than the other of keys 80, 82 in order to enable precise angular orientation of the insert with respect to the shell.

Insert 50 further is provided with a flat 84 which extends partially toward rearwardly facing shoulder 76 of the insert to define a forwardly facing shoulder 86 for latching engagement with inwardly canted tongue 64 on shell 44 when the insert is positioned and retained within the shell. The axial dimension of flat 84 with respect to tongue 64 and the spacing between shoulders 58 and 76 are such that O-ring 78 is somewhat compressed into sealing engagement when tongue 64 latches against shoulder 86.

Shell 44 is further provided with a forwardly extending detent 88 for engagement within a slot 90 in a flange 92 of insert 50 for further orientation between the insert and the shell.

Figure 6:
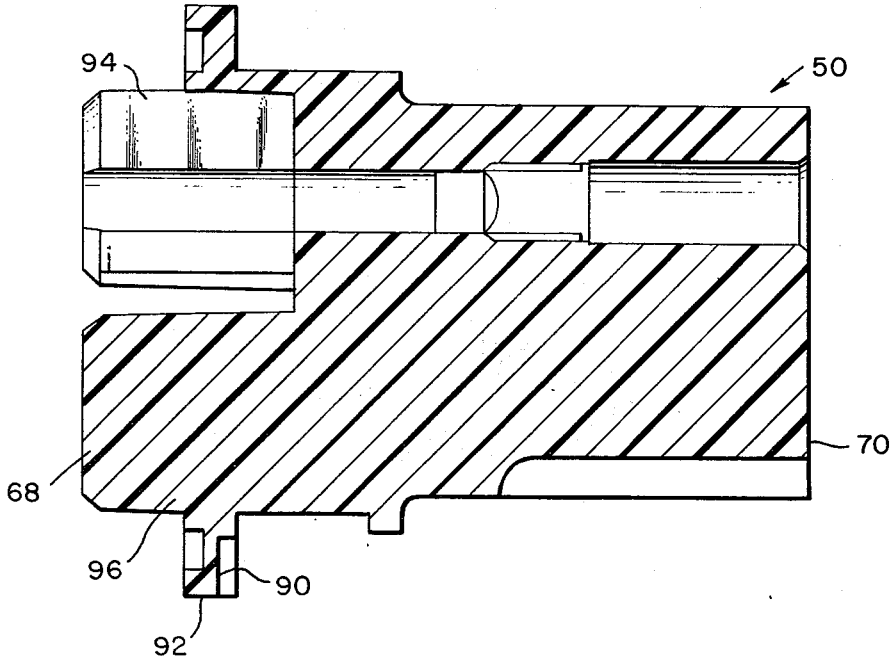
FIG. 6 is a side view in cross-section of the plug insert.
Figure 7:
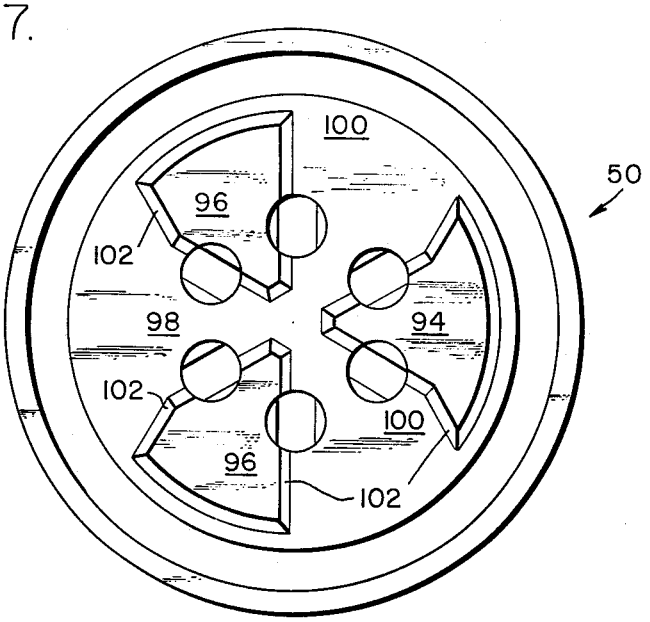
FIG. 7 is an end view of the plug insert illustrating the hermaphroditic, orienting meeting means, useful also in receptacle connectors.
Figure 8:
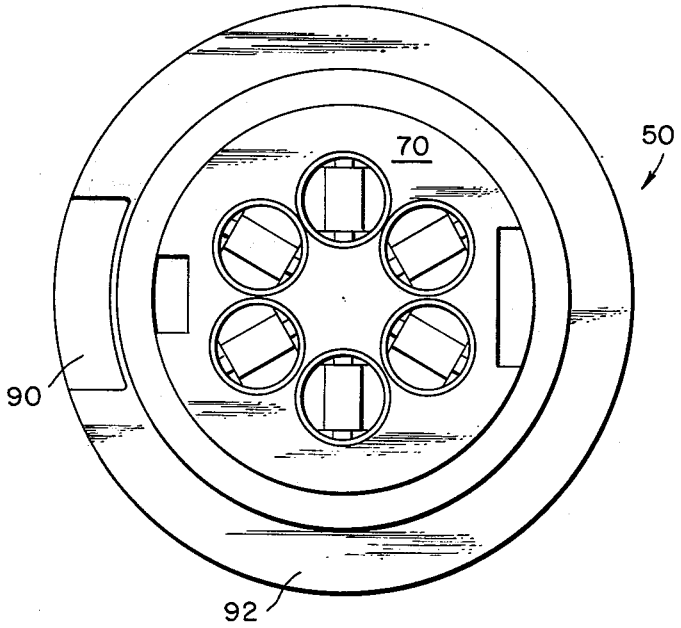
FIG. 8 is the other end view of the plug insert.

Referring in greater detail to FIGS. 6 and 7, insert 50 includes a plurality of keying protrusion sections 94 and 96 at its front end 68 of generally triangular cross-section. There are half as many keying sections as there are contacts, since it is one important feature of the present invention that each contact be protected by the flanking sides of the keying sections. As illustratively described herein, six contacts and three keying sections are shown, in which a single keying section 94 is of greater cross-sectional dimension than the remaining two sections 96. The sections are spaced from one another in such a fashion as to provide three circumferentially spaced recesses 98 and 100, recess 98 having substantially the same configuration as protrusion 94 while recesses 100 have essentially the same configuration as protrusions 96. Since all front sections of plug 10 and receptacle 12 have the same protrusion, recess and spacing configurations, it follows that a plug-to-plug or plug-to-receptacle connection is totally hermaphroditic and further provides a connection in only one preselected angular orientation between connectors.

Each of keying protrusion sections 94 and 96 are provided with sidewalls 102. Within these sidewalls, bores 93 extend as substantially half tubular recesses to enable the electrical contacts to be housed therewithin. Accordingly, all electrical contacts 36 and 36a residing within the respective bores 32 and 93 are protected by keying protrusion sections 94 and 96 as laying partially within their walls 102. Further, when a plug-to-plug or plug-to-receptacle connection is made, the half bores within the mating keying sections cooperate to fully enclose the contacts and to enable sliding and wiping electrical coupling between mating contacts.

Coupling ring 30 is positioned about shell 44 and is provided with an internal thread 104 for cooperation with an external thread 106 on insert 44 and coupling with thread 28 of receptacle 12. Therefore, thread 104 of coupling ring 30 may engage with a corresponding thread 28 of a mating receptacle, such as receptacle 12, or another plug, such as plug 10. It is to be understood that, because all plugs are provided with coupling rings, when a plug-to-plug connection is made, only one of the coupling rings is used for the connection while the other coupling ring is slid backward to rear end 18 and is not used, and prevented from rotation by antirotation teeth 105 cooperating with notches in ring 30.

The coupling ring further is provided with a radially inwardly extending lip 108 having an internal surface 110 for compressing an O-ring 112 against a rearwardly facing shoulder 114 so as to enable sealing and engagement when a plug-to-plug or plug-to-receptacle engagement is made.

Wire sealing means 52 comprises an elastomeric annular seal 116 having inwardly directed walls 118, one of which abuts against inwardly extending annular wall 62 of shell 44, substantially rigid annular compression ring 120 seated against the other wall 118 of seal 116, and a gland nut 122 which is adapted to engage compression ring 120. Gland nut 122 has a threaded connection 124 with shell 44 so that, when the gland nut is threaded onto the shell, its cap 126 presses against compression ring 120 which, in turn, presses against seal 116, thereby forcing and extruding the seal against cable 22 to seal the latter within shell 44.

Figure 10:
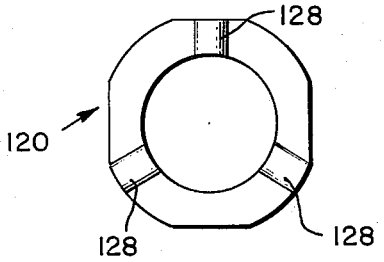
FIG. 10 is a side view of a compression ring utilized in the plug connector.
Figure 11:
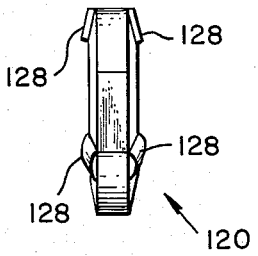
FIG. 11 is an edge view of the compression ring depicted in FIG. 10.

As shown in FIGS. 10 and 11, compression ring 120 is provided with radially spaced protuberances 128 on both side surfaces while gland nut 122 (FIG. 9) is provided with indentations 130 radially disposed about its end cap 126 so as to provide a latching engagement between the gland nut and the compression ring whereby, when the gland nut is threaded onto the plug shell, the gland nut end cap 126 presses against the compression ring to compress the annular seal 16 against the insulated wires 22 and to latch against the compression ring for inhibiting reverse threading between the gland nut and the plug shell.

Specifically, as gland nut 122 is threaded onto shell 44 through the interaction of their respective meshing threads, cap 126 presses against compression ring 120 which, in turn, presses against elastomeric annular seal 116. Because seal 116 contacts radially inwardly extending annular wall 62, which is integral with shell 44, seal 116 is compressed and seals against wires 22, as stated above. As a corollary, compression of elastomeric seal 116 provides a reverse spring pressure exerted against compression ring 120 which, in turn, is pressed against cap 126 of nut 122, thus resulting in increased seating and enhanced latching of any of protuberances 128 in compression ring 120 within any of indentations 130 of gland nut cap 126. Because of at least the frictional and compressed contact between seal 116 and both compression ring 120 and annular wall 62 of shell 44, as well as the threaded engagement and resulting contact between nut 122 and shell 44, the compressed and latching between protuberances 128 and indentations 130 inhibit reverse threading between gland nut 122 and plug shell 44. This inhibition of reverse threading is in addition to and in enhancement of any frictional forces otherwise exerted on these parts. It is to be understood, of course, that such inhibition occurs also when nut 122 is threaded onto shell 44, or intentionally removed therefrom, but does not present any problems because it is intended, by deliberate application of turning forces on nut 122, that the latching contact be overcome. As a consequence, latching between protuberances 128 and indentations 130 enhance any frictional forces and inhibit unintentional reverse threading between shell 44 and nut 122, thereby helping to maintain the electrical and assembled integration of plug 10. Protuberances 128 also act to enhance the frictional contact and to inhibit turning between compression ring 120 and annular seal 116.

Although the invention has been described with reference to a particular embodiment thereof, it should be realized that various changes in modifications may be made therein without departing from the spirit and scope of the invention.

What is claimed is:

1. An electrical connector assembly comprising:

a plug of generally circular cross-section having an even number of electrical contacts therein with insulated wires secured to said contacts, and a receptacle of generally circular cross-section having the same even number of electrical contacts therein with insulated wires secured to said plug electrical contacts for electrical engagement with said plug electrical contacts;

said receptacle having an external thread thereon and means for defining the same even number of bores spaced equally from each other and about the axis of said receptacle and extending therethrough from a front end to a rear end for reception of said receptacle electrical contacts, said receptacle further having one-half the same number of keying protrusion sections as there are contacts, said keying protrusion sections being of generally triangular cross-section at said front end with means for defining circumferentially spaced recesses between said sections, one of said sections being of larger circumferential size than the remaining sections, each of said keying sections being bounded by two generally radially extending side walls with each of said bore means extending along and partially within each of said walls;

said plug comprising a shell having a forward end and a rear end, an insert positioned within said forward end of said shell in keyed angular orientation therewith, an O-ring between said insert and said shell, a coupling ring rotatably journalled about said shell, and wire sealing means secured to said shell at said rear end, said shell having a generally tubular configuration and comprising means for defining a first bore at said forward end, a second bore of lesser diameter than said first bore means extending therefrom towards said rear end for defining with said first bore means a forwardly facing shoulder, and a third bore at said rear end of diameter substantially the same as said second bore means, said shell further comprising a rearwardly and radially inwardly extending annular wall between said second and third bore means and a radially inwardly canted tongue at said forward end extending into said first bore means and towards said rear end, said insert having a front end and rear end and comprising a generally cylindrical body having a first section of diameter substantially equal to that of said shell first bore means for insertion therein, a second section of diameter substantially equal to that of said shell second bore means for insertion therein and terminating at said insert rear end for defining with said first section a rearwardly facing shoulder for sealing said O-ring against said shell forwardly facing shoulder, one-half the same number of keying protrusion sections as there are contacts, said keying sections being at said insert front end with means for defining circumferentially spaced recesses between said keying sections and configured identically as said receptacle shell keying sections and recess means whereby said insert and said receptacle are mateable in only one preselected angular orientation, said insert further including means for defining the same even number of bores spaced equally from each other and about the axis of said insert and extending therethrough from said front end to said rear end and along and partially within the side walls of said insert keying sections for reception and protection of said plug electrical contacts, said insert first section having a flat formed therein extending partly towards said insert rearwardly facing shoulder for defining a forwardly facing shoulder for biased latching engagement aided by compression of said O-ring with said inwardly canted tongue on said shell when said insert is inserted therein, said coupling ring having an internal thread for engagement with said receptacle thread and for securing said plug to said receptacle, said coupling ring further having a radially inwardly extending lip for engagement with an abutment on said plug shell for limiting movement of said coupling ring towards said shell forward end for enabling said plug to receptacle securement, and said wire sealing means comprising an elastomeric annular seal bounded by inwardly bevelled side surfaces and seated within said plug shell third bore means and against said plug inwardly extending annular wall, a compression ring bounded by outwardly bevelled side surfaces having radially spaced protuberances thereon and seated within said plug shell third bore means and against said annular seal, and a gland nut threadedly engaged with said plug shell and including an end cap having means therein for defining an opening for said insulated wires extending from said plug contacts, through said annular seal and said compression ring, said gland nut having indentations spaced about said opening means for mating and latching engagement with said spaced protuberances on one of said compression ring bevelled surfaces and, when said gland nut is threaded onto said plug shell, for pressing said gland nut end cap against said compression ring and said annular seal and thereby for compressing said annular seal against said insulated wires and for latching against said compression ring for inhibiting reverse threading between said gland nut and said plug shell.

2. An electrical connector assembly comprising a pair of connectors each having a mating end, and means at said mating ends of said connectors for coupling said connectors together in only one preselected angular orientation therebetween, one of said connectors comprising a plug including a shell and an insert adapted to be positioned within and to said shell, one of said shell and said insert including at least one resilient tongue extending towards and in the path of the other of said shell and said insert while the other of said shell and said insert including means for defining at least one recess terminated by a shoulder for enabling said tongue to bend thereover and to snap within said recess means for latching engagement therewith upon positioning of said insert within said shell, and means for defining a resilient seal compressed against said shoulder between said shell and said insert for providing a seal therebetween and for exerting a bias against said tongue for aiding in maintaining said latching engagement of said tongue in said recess means.

3. An electrical connector assembly as in claim 2 wherein said coupling means comprises means for defining protrusions on each of said connectors and means for defining recesses on each of said connectors, said recess means having substantially the same mating configuration as said protrusion means.

4. An electrical connection assembly as in claim 3 further including means for defining bores for reception of electrical contacts, the number of said protrusions being one-half the number of said bores.

5. An electrical connector assembly as in claim 3 wherein said protrusion means and said recess means have cross-sections of non-uniform angular widths for enabling the coupling of said connectors in only the one preselected angular orientation.

6. An electrical connector as in claim 3 wherein said protrusion means and said recess means have generally triangular configurations in cross-section.

7. An electrical connector assembly as in claim 3 wherein said protrusion means and said recess means comprise at least two generally triangular configurations in cross-section, one of said configurations having a side of greater length than the remainder of said configurations.

8. An electrical connector assembly as in claim 3 wherein said protrusion means and said recess means each comprise one protrusion and one recess means of generally triangular cross-sectional configuration having a side of first length and the remaining protrusions and recess means of generally triangular cross-sectional configuration each having a side of length less than the afore-mentioned first length.

9. An electrical connector assembly as in claim 3 wherein said connectors each have axes which form a single axis when said connectors are coupled together, wherein said protrusion means and said recess means are centered about both connector axes, and wherein said protrusion means and said recess means each comprise at least two triangular cross-sectional configurations each having two sides generally radially extending from their respective axes and a third side joining said two sides, said third side of one of said protrusion means and said recess means being of different length than said third side of the remainder of said protrusion means and said recess means.

10. An electrical connector assembly as in claim 9 wherein said connectors each have means for defining bores extending axially therethrough for reception of electrical contacts, each of said bore means extending along and partially within said two sides of each of said protuberance means for enabling protection of said electrical contacts from mechanical damage while enabling electrical coupling between electrical contacts in said plug and said receptacle when coupled together.

11. An electrical connector comprising a body having means therein for defining a bore for receiving an electrical cable, said body including means for resiliently clamping about said cable and within said bore means for sealingly retaining said cable in position within said body and for preventing moisture from entering within said bore means, said clamping means including an inwardly extending wall on said body within said bore means, an elastomeric seal positioned in said bore means and against said inwardly extending wall, a compression ring positioned in said bore means and against said elastomeric seal, and a gland nut rotatably and axially engageable with said body and including an end cap having means therein for defining an opening for receipt of said cable, said gland nut and said compression ring having means for defining mutually engaging latches and, when said gland nut is engaged with said body, for compressing said compression ring against said elastomeric seal for sealing thereof against said cable, said latching means between said gland nut and said compression ring maintaining the rotational and axial engagement between said gland nut and said body.

12. An electrical connector as in claim 11 wherein said mutually engaging latches means between said gland nut and said compression ring comprises protuberances on one of said compression ring and said gland nut extending towards the other of said gland nut and said compression ring, and indentations on the other of said gland nut and said compression ring facing said one of said compression ring and said gland nut for engagement and latching with said protuberances.

13. An electrical connector as in claim 11 wherein said inwardly extending wall and said compression ring have surfaces canted for encouraging extrusion and sealing contact of said elastomeric seal about said cable.

* * * * *